US006007589A

United States Patent [19]

Talbert

[11] Patent Number: 6,007,589

[45] Date of Patent: Dec. 28, 1999

[54] E-GASOLINE II A SPECIAL GASOLINE FOR MODIFIED SPARK IGNITED INTERNAL COMBUSTION ENGINES

[75] Inventor: William L. Talbert, York, Pa.

[73] Assignee: Talbert Fuel Systems Inc., Allentown, Pa.

[21] Appl. No.: 09/193,740

[22] Filed: Nov. 17, 1998

[51] Int. Cl.[6] ..... C10L 1/06

[52] U.S. Cl. ..... 44/300; 123/1 A; 123/557; 208/16; 585/14

[58] Field of Search ..... 123/1 A, 557; 208/16, 17; 585/14; 44/300

[56] References Cited

U.S. PATENT DOCUMENTS

| | | | |
|---|---|---|---|
| 4,824,552 | 4/1989 | Nagasawa et al. | 208/17 |
| 4,955,332 | 9/1990 | Talbert | 123/1 A |
| 5,015,356 | 5/1991 | Talbert | 208/16 |
| 5,256,167 | 10/1993 | Kaneko et al. | 44/449 |
| 5,288,393 | 2/1994 | Jessup et al. | 208/16 |
| 5,312,542 | 5/1994 | Talbert | 208/16 |
| 5,593,567 | 1/1997 | Jessup et al. | 208/46 |
| 5,653,866 | 8/1997 | Jessup et al. | 208/46 |
| 5,837,126 | 11/1998 | Jessup et al. | 208/16 |

*Primary Examiner*—Jacqueline V. Howard
*Assistant Examiner*—Cephia D. Toomer
*Attorney, Agent, or Firm*—Bacon & Thomas

[57] ABSTRACT

A fast burning, gasoline type composition for spark ignited internal combustion engines having a ASTM D-86, 90% distillation temperature of 310° F. or less and an octane number (R+M)/2 of 80 or less that can be used with a reduced spark advance in the engines to effect a reduction in NOx exhaust emissions.

10 Claims, 1 Drawing Sheet

Fuel Effects on Auto Exhaust Emissions
Current Vehicles – 1989
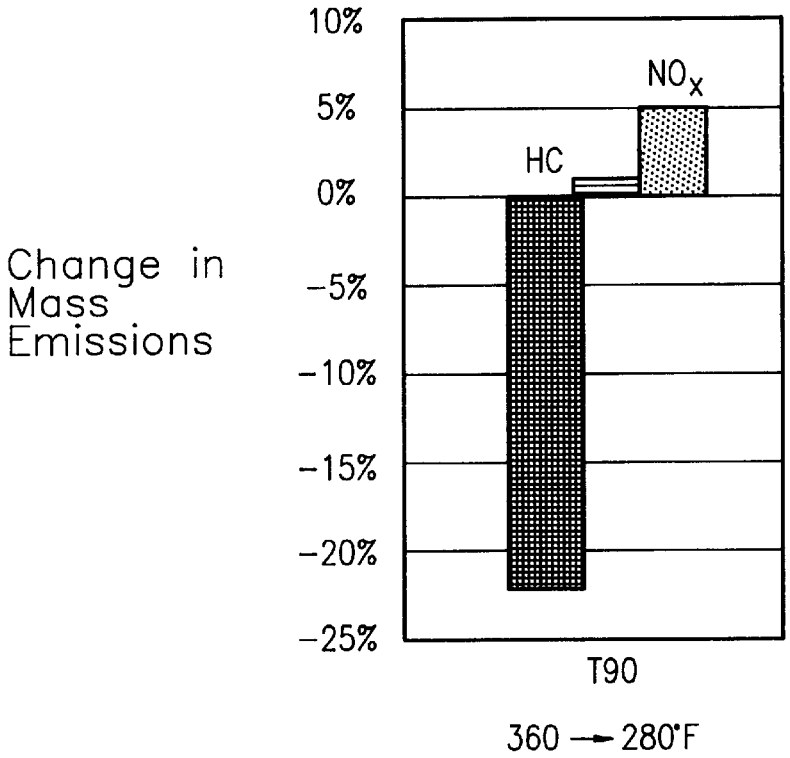
From extensive data developed by the Air Quality Information Research Program.

E-GASOLINE II A SPECIAL GASOLINE FOR MODIFIED SPARK IGNITED INTERNAL COMBUSTION ENGINES

FIELD OF THE INVENTION

The present invention pertains to gasoline compositions and the use thereof in spark ignited, internal combustion engines as in automobile type engines.

BACKGROUND INFORMATION

Pollutants produced by combustion include oxides of nitrogen which are more commonly referred to as $NO_x$ (where x is an integer which represents the number of oxygen atoms in the molecule). Such oxides include NO and $NO_2$. In the combustion process $NO_x$ is formed by air (a gas containing nitrogen and oxygen) being subjected to high temperatures for a period of time. Recent studies have been made on lower 90% distillation temperature gasoline which show that faster burning gasoline (lower 90% distillation temperature) comes up to high temperature more rapidly increasing the time the nitrogen and oxygen in the air are exposed to high temperature thereby causing an increase in $NO_x$ (see the FIGURE). This type of fuel is described in U.S. Pat. No. 5,015,356 which is incorporated herein by reference.

Gasolines now used as fuel in current spark ignited internal combustion engines require octane numbers (R+M)/2 falling almost entirely within the range of 84–94. Some engines require a higher octane gasoline than others depending on their compression ratio or carbon deposit buildup (age) in order to avoid or reduce engine "knock" or to improve fuel combustion efficiency.

Lower octane gasolines have been used in the past in low compression engines but were abandoned in common practice because of poor efficiency and power output. It would be highly desirable if lower octane gasolines could be efficiently used in currently available engines especially if their use resulted in reduction of $NO_x$ pollution.

SUMMARY OF THE INVENTION

An object of this invention is to provide a novel gasoline for use in a spark ignited internal combustion engine that will permit or allow reduction of $NO_x$ emissions.

It is a further object of this invention to provide a method for achieving $NO_x$ reduction by engine modification so that the fuel of this invention can be efficiently used. It has been discovered that the fuels of this invention which have a low octane rating can nonetheless be used in conventional internal combustion automobile engines by merely reducing the spark advance of the engine.

It is a still further object of this invention to provide a gasoline that will perform well at air to fuel ratios above stoichiometric in an internal combustion engine.

It is yet another object of this invention to provide a liquid fuel that can be formed into a vapor or gaseous state and yet will tend to remain in this state when mixed with induction air in an internal combustion engine.

These and other objects are obtained with a gasoline that has a low 90% distillation temperature and a low octane number. The low 90% distillation temperature is used so that the gasoline can burn quickly and more thoroughly when mixed with air and ignited in an engine. The low octane number is utilized so that the combustion rate with air is rapid. The octane number may be lowered by known techniques such as by reducing the amount of high octane components used in the production of the gasoline or by reducing the octane booster additives which are conventionally added to gasoline. The desired distillation temperature can be achieved by conventional gasoline production techniques such as by distilling the heavy ends off of gasoline blending streams in a refinery.

BRIEF DESCRIPTION OF THE DRAWING

The FIGURE is a graph which shows the effects on auto exhaust emissions when the ASTM D-86 90% distillation temperature is reduced from 360° F. to 280° F.

DETAILED DESCRIPTION OF THE INVENTION AND PREFERRED EMBODIMENTS

Lower endpoint gasoline reduces "cylinder wall wetting", thus permitting less "knocking" in an engine at octane levels less than the minimum established by the state and federal regulators for modern, Phase 2 gasoline—87 octane minimum. All of the octane numbers indicated herein are determined from the formula (R+M)/2 where R is defined by ASTM D-2699 and M is defined by ASTM D-2700. Through testing and using standard federal test procedures, it has been discovered that such lower endpoint gasoline can be used to operate a standard automobile engine without knocking even though the gasoline has an octane number (R+M)/2 less than 82 (e.g., as low as 81.8). An example of such a fuel with a 90% distillation temperature of less than 310° F. is the "special" gasoline of Example 1. Example 1 shows a comparison between conventional gasoline and a gasoline of the present invention (designated herein as "SPECIAL") having an ASTM D-86 90% distillation temperature of less than 310° F.

Previously low octane gasolines were used for low compression engines. However, it was discovered that by lowering the 90% distillation temperature as determined by ASTM D-86 distillation tests to 310° F. or less, (preferably from 252°–282° F.) the octane number of currently available gasoline could also be lowered and used in today's engines which now require gasolines having an octane number of 84 or higher. The fuels of this invention have octane ratings of less than 82, most preferably less than 80.

In engine dynamometer testing (example 2) it was further discovered that lower 90% distillation temperature gasoline could operate a standard automobile engine at less spark advance than would be required for the same engine burning conventional 87 octane gasoline. Furthermore, it was also discovered that burning low 90% distillation temperature gasoline in the engine with less spark advance achieved reduced emissions, particularly reduced emissions of $NO_x$. This is very important in that lower 90% distillation temperature gasolines normally increase $NO_x$ emissions (see the FIGURE) but by reducing spark advance these same fuels can operate at reduced levels of $NO_x$ emissions (see example 2). Lowering spark advance also permits a further reduction in octane number (R+M)/2 to less than 81.8, preferably to 80 or less.

Thus the present invention is useful for improving the reduction of $NO_x$ emissions from a spark ignited internal combustion engine which has at least one combustion chamber therein and a spark advance setting which is set at a minium effective amount to avoid engine knocking when gasoline having an octane number rating of at least 82 is used as a fuel to run the engine. The improvement resides in the use of the gasoline of this invention in the above-noted internal combustion engine wherein the gasoline comprises a hydrocarbon mixture having an ASTM D-86 90% distillation temperature of 310° F. or less and an octane number (R+M)/2 which is less then 82 with the proviso that the spark advance of the engine is retarded an effective amount to avoid engine knocking when running the engine with the fuel of this invention.

The gasoline of this invention uses standard gasoline components which may include additives and/or oxygenates. Thus, apart from the lower 90% distillation temperature and lower octane, the gasoline of the present invention is otherwise the same as conventional gasoline which is currently available.

In a preferred embodiment the ASTM D-86 90% distillation temperature falls within the range of 265° F. to 285° F. In addition, the octane number of the gasoline is preferably in the range of 72–82. Such a gasoline can lower the pollutants in the exhaust of a conventional internal combustion engine by retarding the spark advance of the vehicle preferably within a 4° to 12° range.

The present invention is unique in that the novel low octane gasoline described herein is workable in currently available engines and also provides improved combustion efficiency and lower levels of combustion pollutants compared to the use of currently available gasolines in these engines. Also the gasolines of this invention are easy to vaporize or gasify and once in the vapor or gaseous state they have improved stability so that they remain in this state when combined with induction air. This characteristic improves the gas-to-air ratio and the ignition properties of higher air-to-fuel ratio combustion charges. The low octane of the gasoline also contributes to higher air-to-fuel ratio combustion since excess air is an excellent octane booster. If octane values get too high, the fuel will not have time to burn completely in the engine. It is well known that fuel combustion efficiency and lower tailpipe pollutants are achieved with air-to-fuel ratios higher than stoichiometric.

In a preferred embodiment the gasoline has a distillation (ASTM D-86) endpoint temperature less than 345° F. and an octane number (R+M)/2 less than 80. The fuel may additionally contain additives, oxygenates, fuel extenders or other compositions which enhance the properties or combustion characteristics of gasoline. Such additives may be used singularly or in any combination thereof.

In operation the fuels of this invention may be used in an internal combustion engine in the form of a liquid, vapor or gaseous state, or in any combination thereof. The use of the fuel of this invention results in a reduction of harmful emissions of combustion from internal combustion engines.

The gasoline of this invention also allows one to achieve reliable ignition of combustion mixtures containing higher air-to-fuel ratios than are currently used in spark ignited internal combustion engines.

EXAMPLE 1

Dynamic testing done at Compliance and Research Services, Inc., Linden, N.J., on an Oldsmobile Cutlass in November, 1989 shows that a fuel designed for improved injector volatilization (i.e., the fuel of this invention having a 90% distillation temp less than 310° F. designated herein as SPECIAL) can perform well without engine knock at low octane. Both HC (hydrocarbon) and CO emissions increase substantially when "knocking" occurs in an engine. In this test the fuel of the invention performed well without elevated emissions of HC and CO, thus establishing that the engine performed well without knocking even though the fuel utilized had an octane rating of only 81.8.

| | GASOLINE* | SPECIAL** |
|---|---|---|
| Emissions | HC (avg) - .146 | HC (avg) - .136 |
| City | CO (avg) - 1.449 | CO (avg) - 1.431 |
| Emissions | HC (avg) - .076 | HC (avg) - .070 |
| Highway | CO (avg) - .785 | CO (avg) - .593 |

*Octane R + M/2 = 92.0
**Octane R + M/2 = 81.8
Emissions data in grams per mile.

EXAMPLE 2

At Pittsburgh Applied Research Center (PARC) tests were done using a Pontiac 4-cylinder engine (2.5 L) with a Go Power Dynamometer and a TEC Electromotive Control System. The following data were taken from spread sheets operating the engine at about 2,000 rpm with all conditions being about the same except for hydrocarbons, NOx and fuel used as per the following chart:

| DATE | HC | NOX | SPARK ADVANCE (measured in degrees) | GASOLINE |
|---|---|---|---|---|
| 06/14/90 | 784 | 1,076 | 49 | Chevron |
| 06/14/90 | 788 | 1,232 | 49 | Chevron |
| 06/13/90 | 800 | 960 | 49 | Special* |
| 06/13/90 | 804 | 968 | 49 | Special* |
| 06/13/90 | 752 | 556 | 43 | Special* |
| 06/13/90 | 744 | 596 | 44 | Special* |
| 06/13/90 | 712 | 368 | 38 | Special* |
| 06/13/90 | 712 | 328 | 38 | Special* |

*less than 310 degrees F., 90% distillation temperature.
Note the change in NOx with the variation in spark advance.

While the present invention has been described in terms of certain preferred embodiments and exemplified with respect thereto, one skilled in the art will readily appreciate that variations, modifications, changes, omissions and substitutions may be made without departing from the spirit thereof. It is intended, therefore, that the present invention be limited solely by the scope of the following claims:

I claim:

1. A gasoline composition for use as a fuel in a spark ignited internal combustion engine, said fuel comprising a hydrocarbon mixture with the proviso that said gasoline has an ASTM D-86 90% distillation temperature of 310° F. or less and an octane number (R+M)/2 which is less than 82.

2. The fuel of claim 1 having an octane value which is 80 or less.

3. The fuel of claim 1 wherein the 90% distillation temperature is in the range of 265° F.–285° F. and the octane number falls within a 72–82 range.

4. A method of operating a spark ignited internal combustion engine having at least one combustion chamber therein and a spark advance setting; said method comprising introducing gasoline and air into said at least one combustion chamber and igniting said mixture with a spark; said gasoline comprising a hydrocarbon mixture with the proviso that said gasoline has an ASTM D-86 90% distillation temperature of 310° F. or less and an octane number (R+M)/2 which is less than 82; with the proviso that said spark advance setting of said engine is set at level whereby knocking is avoided while said engine is running.

5. The method of claim 4 wherein said gasoline has an octane number which is 80 or less.

6. The method of claim 4 wherein the gasoline has an ASTM D-86 90% distillation temperature in the range of 265° F.–285° F. and the octane number (R+M)/2 falls within the 72–82 range.

7. In a method for reducing $NO_x$ emissions from a spark ignited internal combustion engine having at least one combustion chamber therein and a spark advance setting which is set at a minimum effective amount to avoid engine knocking when gasoline having an octane rating of at least 82 is used as a fuel to run said engine; wherein the improvement comprises using gasoline of the invention as the fuel in the operation of the engine with the proviso that the spark advance is retarded an effective amount to avoid engine knocking; said gasoline comprising a hydrocarbon mixture having an ASTM D-86 90% distillation temperature of 310° F. or less and an octane number (R+M)/2 which is less than 82.

8. The method of claim 7 wherein the gasoline has an octane number which is 80 or less.

9. The method of claim 7 wherein the gasoline has an ASTM D 86 90% distillation temperature in the range of 265° F.–285° F. and an octane number (R+M)/2 falling within a 72–82 range.

10. A gasoline fuel composition for use in a spark ignited, internal combustion engine, said fuel comprising a hydrocarbon mixture with the proviso that said mixture has an ASTM D 86 endpoint temperature less than 345° F. and an octane number (R+M)/2 less than 80 and where said composition optionally includes additives and fuel extenders common to gasoline.

* * * * *